United States Patent [19]

Rohde

[11] 4,015,775

[45] Apr. 5, 1977

[54] METHOD OF GRADIENT SEPARATION

[75] Inventor: Vernon Carl Rohde, Newtown, Conn.

[73] Assignee: E. I. Du Pont de Nemours and Company, Wilmington, Del.

[22] Filed: July 16, 1975

[21] Appl. No.: 596,234

[52] U.S. Cl. ..... 233/26; 210/DIG. 23

[51] Int. Cl.[2] ..... B04B 5/02

[58] Field of Search ..... 233/1 R, 16, 25, 26, 233/27; 210/83, 84, DIG. 23, DIG. 24

[56] References Cited

UNITED STATES PATENTS

| | | | |
|---|---|---|---|
| 3,243,105 | 3/1966 | Anderson | 233/1 R |
| 3,459,369 | 8/1969 | Marks | 233/26 |
| 3,768,727 | 10/1973 | Proni | 233/26 |
| 3,850,369 | 11/1974 | Bull et al. | 233/26 |

OTHER PUBLICATIONS

Beckman/Spinco Publication SBE–3, Analytical Ultracentrifuge, Model E, May 1960.

National Cancer Institute Monograph, Zonal Centrifuge, N. G. Anderson et al. No. 21, pp. 253–283, June, 1976.

Beckman Instruments Catalog, Analytical Cells, Spinco SB–189E, Dec. 1973, p. 11.

Analytical Biochemistry Publication, "Density Gradient Centrifugatin in Angle Head Rotors" pp. 477–478, Fisher et al. 1964.

*Primary Examiner*—George H. Krizmanich

[57] ABSTRACT

Zonal separations by centrifugation are achieved by first preparing a fluid density gradient in stationary, vertically disposed containers each having a length which exceeds its diameter. A sample to be separated is placed on the top of each gradient within the container. These containers are centrifuged, while maintaining their vertical orientation about a vertically oriented spin axis to reorient the fluid density gradient from vertical to horizontal and to create a horizontal separation gradient of the sample within each tube. Following centrifugation a vertical gradient is again established in each container. This vertical gradient facilitates withdrawal of the now separated particles from the several separation zones. The relatively short path length of the horizontal gradient provides a relatively steep horizontal gradient which during centrifugation speeds up the separation process. The relatively steep horizontal gradient also aids in establishing sharp, narrow separation bands, while the reorientation back to vertical facilitates their examination.

3 Claims, 6 Drawing Figures

METHOD OF GRADIENT SEPARATION

CROSS-REFERENCE TO OTHER APPLICATIONS

An apparatus for gradient separation is described and claimed in an application Ser. No. 596,233, filed in the names of William A. Romanauskas and Oakley L. Weyant on July 16, 1975 and assigned to the same assignee as this application.

BACKGROUND OF THE INVENTION

This invention relates to density gradient centrifugation separations and, more particularly, to reorienting the density gradient in vertical tubes to enhance the speed of separation and facilitate recovery of the separation zones.

The field of centrifuging is a relatively old field. It is based upon the use of centrifugal force to separate particles. Such force causes the particles to move outwardly from the rotational center of the rotor towards the periphery. This is called sedimentation. The sedimentation rate is dependent upon several factors. These factors include rotational speed, the density and viscosity of the medium in which the particles are suspended, the density of the particle, and the size and shape of the particle.

Utilizing these various criteria, the particles are separated in space by the differing distances they traverse along the centrifugal force vector. The degree of separation along this force vector, often termed a separation gradient, determines the degree of resolution with which particles may be separated.

In one type of separation, known as density gradient separation, a column of liquid in which the density of the liquid varies in a known way from one end of the column to the other, is used. Thus when the particle under the influence of centrifugal force reaches the point of its isopycnic density, i.e., the density of the surrounding liquid, it will cease to migrate along the force vector in either direction.

Swinging bucket centrifuges typically are used for this purpose. A disadvantage of this type of separation is that the required separation times can be extreme, even when ultra centrifuges are used, because of the relatively long path length the particles must travel to be separated from one another. While a disadvantage in separation time, the container length is a decided advantage in recovery of the separation zones or bands. The long column provides for a relatively wide separation of the bands of particles which is a decided advantage. It would be desirable to achieve shorter separation times and yet retain the advantages of long path length during recovery.

In addition to swinging bucket rotors, zonal centrifuge rotors have been devised for density gradient separation work. One such is described in U.S. Pat. No. 3,243,105 issued Mar. 29, 1966 to Norman G. Anderson. Anderson provides a bowl type rotor in which a density gradient is established. The problems encountered with the Anderson approach are many and are based to a large extent upon the fact that the spin axis passes directly through the bowl. This means that portions of the sample must go through relatively large area changes with attendant, excessive shearing. This excessive shearing tends to disturb the separation and therefore decreases the resolution and purity of separation.

An improvement over Anderson is described in U.S. Pat. No. 3,708,111 issued Jan. 2, 1973 to Phillip Sheeler et al. There is described in Sheeler et al a reorienting gradient zonal rotor in which the rotor is a cylindrical chamber divided into a plurality of sector-shaped compartments. The floor or ceiling of the chamber defines a U-shaped annular groove to increase the path length and hence increases the separation of the bands as they are recovered. Unfortunately the separation path length is relatively long with the attendant separation time disadvantages.

Accordingly, it is the object of this invention to obviate many of the disadvantages of the prior art methods of centrifuge gradient separations.

Another object of this invention is to provide an improved method of density gradient centrifugation.

SUMMARY OF THE INVENTION

According to the method of this invention, particulate matter in a sample is separated as a function of the physical characteristics of the matter by the steps of introducing said sample into a vertically oriented column of liquid under stationary conditions; rotating said vertically oriented column of liquid about a vertical spin axis (other than the longitudinal axis of said column) to separate said matter along a horizontal gradient in said liquid; and reorienting said horizontal separation gradient to a vertical separation gradient.

The separation may be a density gradient separation, rate gradient separation or otherwise. In any event, by reorienting the gradient from vertical to horizontal and by forming the centrifuge column such that its length is greater than its diameter, the time required for separation is reduced. By reorienting the gradient to vertical the advantages of a long path length for band recovery is attained, i.e., a relatively wide separation of bands is obtained and resolution of separation is enhanced. As a further advantage, the bottoms as well as the tops of the columns are rounded to further reduce any shear and consequent remixing of the separation bands which otherwise tends to occur during reorientation of the gradients.

BRIEF DESCRIPTION OF THE DRAWINGS

Further advantages and features of this invention will become apparent upon consideration of the following description wherein.

DESCRIPTION OF THE PREFERRED EMBODIMENT

Figure 1:
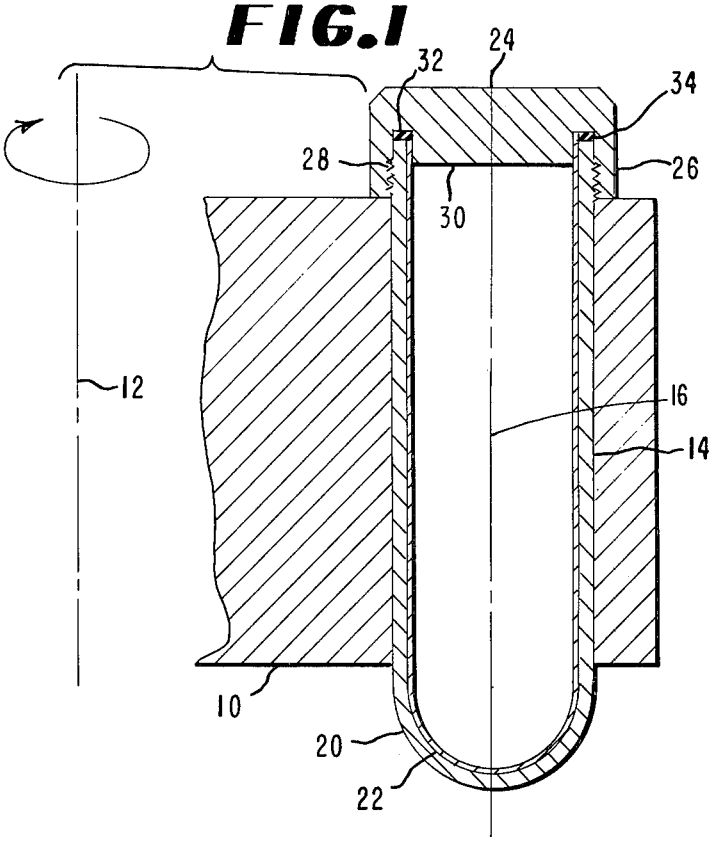
FIG. 1 is a fragmentary and partially schematic cross-sectional representation of a centrifuge and rotor capable of facilitating the method of this invention.
Figure 2:
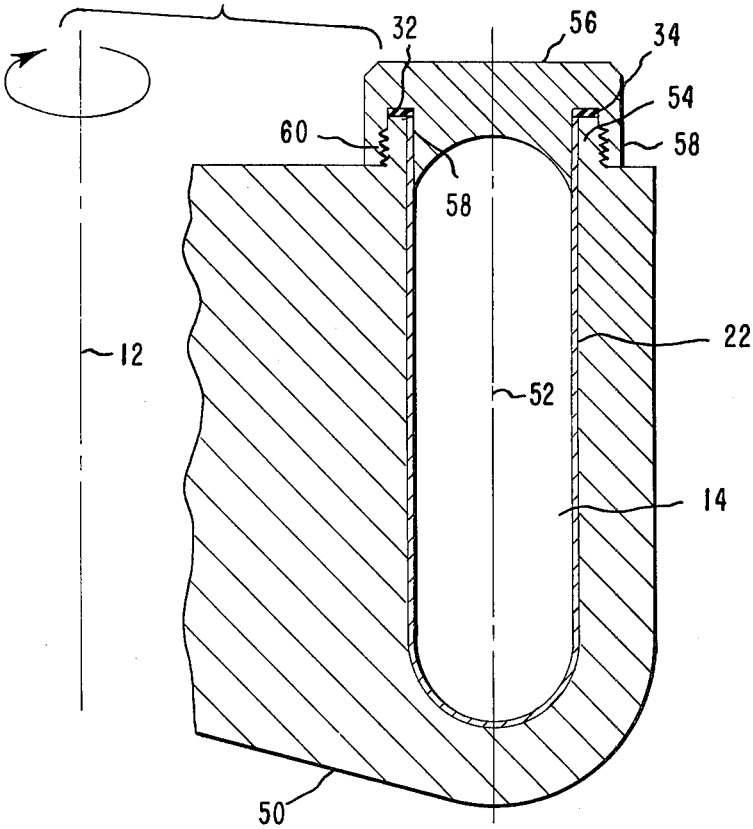
FIG. 2 is a fragmentary partially schematic, partially cross-sectional view of an alternative centrifuge rotor capable of implementing the method of this invention.

The method of this invention may be implemented using a conventional centrifuge of known type in which a rotor 10 is adapted to be rotated or spun about a vertically oriented spin axis 12 (FIG. 1). The outer peripheral portion of the rotor has a plurality of circumferentially spaced cavities 14 (only one of which is shown). Each of the cavities 14 is vertically oriented, i.e., it has a vertical axis 16. Each cavity 14 is adapted to receive an adaptor 20 with a sliding fit. The adaptor preferably is made of a rigid material having a high degree of tensile strength such as steel, aluminum and the like. Positioned within the adaptor 20 is a sample container 22 which may conform to the interior design of the adaptor, may be tubular in form and preferably has a length to diameter ratio which is greater than one for reasons hereinafter described. The container has a sliding fit within the adaptor and preferably has a rounded bottom. A cap 24 is designed to fit over the exterior of the adaptor 20 and has a downwardly extending annular skirt portion 26 the interior of which is threaded as at 28 as to engage corresponding threads on the upper outside portion of the adaptor 20.

A stem portion 30 of the cap 24 extends downwardly inside the sample container 22 so as to form an annular groove 32 above the upper lip of the adaptor 20 and the sample container 22. This groove 32 may accommodate an O-ring 34 so that when the cap is tightened a suitable seal is provided. The primary function of the adaptor is to provide suitable tensile strength to withstand the forces generated within the fluid during centrifugation.

Alternatively, an elongated container having a partial sector-like cross section may be used with the sides each falling on a radius of the rotor. This configuration has certain advantages in use but is more difficult to construct.

According to the method of this invention the elongated sample container 22 while in a stationary position, not necessarily while in the rotor, is filled with a fluid or liquid having or capable of forming a density gradient in a well known manner. The density gradient may typically be formed of sugar with a most dense portion of the fluid solution being at the lower portion of the tube so as to form bands or zones of fluid each band progressively less dense as one progresses to the upper regions of the sample container 22. With this done a small portion of a sample material to be separated is placed at the top of the column of fluid formed by the container. The column of fluid in the sample, i.e., the sample container 22, is then introduced into the adaptor 20. The adaptor is placed within the rotor body 10 and the O-ring 34 and cap 24 tightened over the top of the adaptor to provide a seal. The condition now existing within the sample container 22 is most clearly seen in FIG. 3 wherein the column of fluid includes a density gradient in the lower portion 39 depicted by the lack of shading whereas the various particulate matter of the sample is illustrated by the pictorial representation 40 in the upper portion of the column 38.

Figure 3:
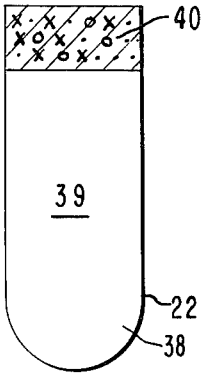
FIGS. 3 through 6 are schematic representations of various stages of a density gradient separation process carried out according to the method of this invention.
Figure 4:
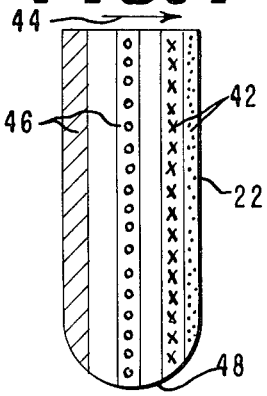

The rotor is now spun about the vertical axis 12 at a high rate of speed causing the fluid column and sample 40 within the container 22 to reorient from the vertical gradient of FIG. 3 to the horizontal gradient of FIG. 4. The more dense portions or zones or bands 42 of the particulate matter moves to the right hand portion in the drawing due to the action of the centrifugal force denoted by vector 44. The bands 46 at the left hand side of the drawing illustration of FIG. 4 contain the least dense particles. It is noted that the entire width of the bands are relatively short and hence provides a relatively steep density gradient. In fact, the diameter of the column 38 is relatively small thereby reducing appreciably the separation times from that required using the column length as occurs in swinging bucket types. Also, it is noted that the cross sectional area (as defined by a plane perpendicular to the force vector 44) is relatively large so that there is little crowding or interference between adjacent particles. This further enhances the speed of the separation.

Figure 5:
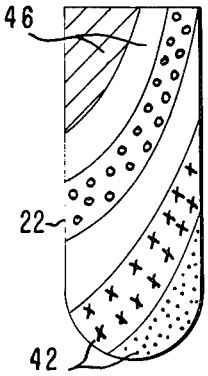
Figure 6:
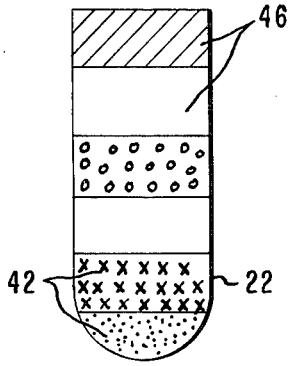

With the separation complete the centrifuge is decelerated and stopped. During deceleration the various bands, particularly those depicted in FIGS. 4 and 5 by numerals 42 and 46, are seen to be in the process of reorientation back to a vertical gradient as depicted in FIG. 6. Because of the bottom of the tube 48 being rounded it is noted that the cross sectional area of a given band contracts in a rather linear manner as it progresses to the form depicted in FIG. 6 where the vertical gradient is re-established with the various bands of now separated particles. Because this change is of a linear nature, the tendency for shear stresses to interfere with the separation is reduced; hence the resolution of the separation is maintained.

Finally with the centrifuge stopped the vertical gradient is fully re-established as depicted in FIG. 6 and the various zonal bands of separated particles may be removed by any of the known procedures available, e.g., pipettes, etc. With the vertical gradient re-established the gradient is seen to be less steep than that of FIG. 4 such that the bands have a greater height or separation. This facilitates separation without undue cross mixing between adjacent bands. It should be further noted that because of the placement of the samples in individual columns or tubes which are centrifuged about, rather than on, the spin axis 12, the shear stresses are appreciably reduced.

In another form of the invention, a rotor body 50 is depicted in a fragmentary, cross sectional view as being capable of spinning about a vertical spin axis 12. In this instance, peripherical cavities are formed in the rotor with a vertical orientation as depicted by the axis 52. In this case each sample container 22 (only one being shown) is placed within a cavity 14 formed in the peripherical portions of the rotor at spaced circumferential intervals as was described in connection with FIG. 1, the only difference being that in the case of FIG. 1 the cavity was a bore which extended all the way through the rotor. Further integral with the rotor body 50 there is formed an upwardly extending annular lip portion 54, the exterior of which is threaded to accommodate a rotor cap 56. As before the cap 56 has a downwardly extending annular skirt portion 58, the interior of which is threaded to engage threads 60 formed on the exterior lip portion 54.

In this instance and in accordance with the method of this invention the downwardly extending stem portion of the cap 56 is formed with a hollow recess 59 so that the upper portion of the container 22 is rounded as is the bottom portion of the container. This further enhances a reduction in the shear stresses which occurs during the reorientation of the gradient from vertical to horizontal and back to vertical. The structure and function of the annular groove 32 and O-ring 34 are the same as previously described.

In all cases it is to be noted that the individual capsules are separately mounted within the rotor with a preferably vertical orientation and spun about a spin axis that preferably is vertical. This has the primary advantage of reducing shear stresses within the fluid column. The shear stresses as noted may be further reduced by rounding the upper and lower portion of the column of fluid.

The length to diameter ratio of the fluid column may be as high as 10 to 1 although higher ratios are not particularly preferred because the shear problems begin to manifest themselves again. A length to diameter ratio of about 3 to 1 is preferred, although larger or smaller ratios may be used. Ratios down to 1 to 1 may be used although as this lower limit is approached, the advantages of this method tend to become reduced. Nevertheless the method is an improvement over the bowl type because of reduced shear stresses.

Although the method preferably spins the elongated columns of fluid about a vertical spin axis, any spin axis may be used. The only requirement of the invention is that the column axis be substantially parallel to the spin axis during centrifugation such that the separation gradient established in the columns be substantially perpendicular to the column longitudinal axis. Actually the separation gradient may in the extreme vary as much as 80° with respect to the column axis (the longitudinal axis of the column intersects a plane normal to the spin axis at an angle as much as 80°), i.e., the column axis forms a ± 10° angle relative to the spin axis, angles of 88° or 89° are preferred, i.e., the column axis forming a ± 1° or 2° angle relative to the spin axis at most with a 0° angle being most preferred.

The method of this invention thus is seen to utilize a short path length and relatively steep gradient during centrifugation and the advantages of a long path length during band recovery. This latter thus uses wide band separation with reduced chance of cross mixing and hence improved resolution. Although described as using density gradients, other known separation gradients such as rate may be used as the separating mechanism.

I claim:

1. A method using density gradient centrifugation of separating particulate matter in a sample as a function of the physical characteristics of the matter comprising the steps of:

introducing said sample into an enclosed elongated column of liquid capable of forming a density gradient or having a density gradient along the longitudinal axis of said column, rotating said column of liquid about a spin axis other than the longitudinal axis of said column such that said longitudinal axis intersects a plane normal to said spin axis at an angle of 90°, whereby said density gradient forms or reorients transversely of said longitudinal axis, reorienting said density gradient along said longitudinal axis, and withdrawing different portions of said liquid and separated particulate matter from said reoriented density gradient along said longitudinal axis.

2. A method as set forth in claim 1 wherein said column of liquid and said spin axis are substantially vertically oriented.

3. A method as set forth in claim 1 wherein said column has a 3:1 height to width ratio.

* * * * *